US006805315B2

(12) United States Patent
Lichtenstul

(10) Patent No.: US 6,805,315 B2
(45) Date of Patent: Oct. 19, 2004

(54) DRAG BOARD ASSEMBLY AND METHOD OF APPLYING A CONTACT PAD TO A DRAG BOARD

(76) Inventor: Joel A. Lichtenstul, 1438 Lyons Chase Cir., Murrysville, PA (US) 15668

( * ) Notice: Subject to any disclaimer, the term of this patent is extended or adjusted under 35 U.S.C. 154(b) by 85 days.

(21) Appl. No.: 10/282,319

(22) Filed: Oct. 29, 2002

(65) Prior Publication Data

US 2004/0079829 A1 Apr. 29, 2004

(51) Int. Cl.[7] ..... B65H 23/00
(52) U.S. Cl. ..... 242/419.4
(58) Field of Search ..... 242/419.4, 548, 242/615.4; 226/195

(56) References Cited

U.S. PATENT DOCUMENTS 2,686,639 A * 8/1954 Campbell ..... 242/419.4
3,046,823 A * 7/1962 Cole ..... 83/175
3,111,285 A * 11/1963 Dunlap, Jr. et al. ..... 226/195
3,229,881 A * 1/1966 Eckhardt ..... 226/195
3,446,052 A * 5/1969 Cetrone et al. ..... 72/250
3,555,873 A * 1/1971 Grant et al. ..... 72/250
4,360,356 A * 11/1982 Hall ..... 493/459
4,508,282 A * 4/1985 Eiting ..... 242/419.4
5,722,577 A * 3/1998 Simpson ..... 226/195

FOREIGN PATENT DOCUMENTS

JP 58144042 A * 8/1983 ..... B65H/23/10
JP 05208214 A * 8/1993 ..... B21C/47/00

* cited by examiner

*Primary Examiner*—Kathy Matecki
*Assistant Examiner*—Sang Kim
(74) *Attorney, Agent, or Firm*—Paul Bogdon

(57) ABSTRACT

A drag board for use in a coil processing line for tensioning or wiping a continuous line of strip material using a substrate to which is selectively secured a contact pad. The leading edge section of the substrate is constructed and arranged for receiving a locking bar which may be activated to apply or release a compressive, securing force on one edge section of the contact pad. Releasing the locking bar permits removal of or emplacement of a contact pad from or onto the substrate.

12 Claims, 4 Drawing Sheets

DRAG BOARD ASSEMBLY AND METHOD OF APPLYING A CONTACT PAD TO A DRAG BOARD

BACKGROUND OF THE INVENTION

1. Field of Invention

This invention relates to a drag board for use in a coil processing line for tensioning or wiping a continuous line of strip material.

2. Description of the Prior Art

Throughout various industries there are used continuous processes for handling coiled material, such as steel, paper, paper by-products, plastics, plastic by-products, aluminum, or other metal products. As part of these processes drag boards, known also as drag wipes, are used to produce tension in the strip to assist in recoiling it or to wipe or otherwise clean the surface of the metal strip.

Most of the drag boards use a wooden substrate to which is attached a contact pad of felt, carpet, abrasive, or other media. The contact pad is secured to the substrate by nailing or stapling, or it may be held by a hook and loop attachment layer secured to the substrate. U.S. Pat. No. 5,722,577 discloses a drag board having a wooden substrate with a hook and loop layer arrangement attached to a protective layer secured to the substrate. A felt contact pad is secured to the hook and loop layer.

There are problems inherent in the existing drag board-contact pad arrangements. Securing contact pads by nailing, stapling, or screwing results in deteriorating of the substrate. The holes formed by the securing members allow oil which is part of the working environment to seep into the interior of the boards and eventual destruction of the boards. Repeated use of the hook and loop arrangement in replacing contact pads results in deteriorating of the heads of the hooks rendering the system ineffective necessitating removal and replacement of the adhering layer. It has also been known that the protective layers, such as lucite, of the hook and loop drag board arrangements have shattered in low temperature environments necessitating replacement. Replacing the layers of the hook and loop drag board arrangements cannot be readily done at the coil processing site. The drag boards are returned to a plant for time consuming and expensive refurbishing and re-laminating. Certain of the hook and loop adhering layers cannot be refurbished or re-laminated and may only be discarded and replaced at significant expense.

Thus, the problems of the known and used drag board-contact pad arrangements are time-consuming, expensive pad replacement, and substrate deterioration because of the holes formed in the substrate by the securing members.

The present invention overcomes the problems inherent in existing drag board-contact pad arrangements, by providing a simple and effective drag board assembly and method of applying a contact pad to a drag board. The assembly is configured to allow efficient and effective on-site replacement of any of its parts without need of special tools while at the same time insuring the integrity of the substrate in preventing deterioration.

SUMMARY OF THE INVENTION

The present invention provides a drag board assembly and method for applying a contact pad to a drag board, the assembly, in its preferred form, including an elongated substrate with its leading edge section constructed and arranged for receiving one edge section or leading edge section of a contact pad. Locking means are provided for engaging the one edge section of the contact pad for selectively securing and releasing the contact pad whereby replacement of a worn pad is simply effected by releasing it from its attachment and a new pad emplaced on the substrate and secured. This invention allows for a direct, simple, efficient, and cost effective contact pad attachment to a substrate of a drag board assembly.

The drag board assembly and method of applying a contact pad to a substrate is useable in any continuous processes for handling coiled material such as steel, paper, paper by-products, plastics, plastic by-products, aluminum, or other metal products. Typical of these processes is slitting with this invention being useable in other processes such as pickling, galvanizing, leveling, and others. The contact pads may be felt, carpeting, or abrasive material. The substrate to which the contact pad is attached may be wood, plastic or plastic derivative, polyurethane, metal or any combination of these materials. The drag board assemblies when used in slitting processes are part of a tension device used to create back pressure to achieve a tight rewind of a recoiling of the slit sheet sections. Tension stands or similar devices are also used to absorb oils from the surface of steel or other products, as well as wick oil or other chemicals on the slit product. Abrasive materials may be used with the drag boards of tension stands for removing rust on secondary or damaged flat rolled steel.

A specific form of the drag board assembly uses a horizontally oriented or specifically shaped steel bar, tube or rod arranged at the leading edge section of the substrate which is configured to snugly receive at least the rear end portion of the tube or rod. A locking rod formed with serrations or protuberance similar to a dull saw blade is secured to the rear end section of the tube or rod which is operably connected with a mechanical pneumatic, or hydraulic power source. The leading edge section of a contact pad is emplaced in between the tube or rod and the interior of the leading edge section of the substrate. The power source is activated to cause the tube or rod and the locking bar to be moved into the confines of the leading edge section of the substrate to engage the leading edge portion of the contact pad and firmly secure it in place to the substrate. The contact pad, securely attached to the substrate, extends over the working surface of the substrate so that it is virtually impossible for any strip material passing over the pad to dislodge it from the substrate of the drag board.

Some of the advantages of the drag board apparatus and method of applying a contact pad to the present invention are positive, quick, and effective, installation of a contact pad on a drag board substrate, on-site replacement of a contact pad, ease of maintenance, no need of special tools for installing a contact pad, and no-need of a back-up drag board while a contact pad is being installed on a substrate. The present invention does not necessitate forming holes from the working surface of the substrate, reducing any deterioration effect of oils and such like on the substrate thereby increasing the useful life of the substrate.

The basic structure of the drag board apparatus of the present invention is simple in construction, relatively inexpensive to produce, and uncomplicated and efficient in its use. The apparatus is modifiable in various ways, for example, in the material used for the substrate, the type of power drive for the locking system, and the type of material used for the contact pad.

Various other advantages, details, and modifications of the present invention will become apparent as the following descriptions of a certain present preferred embodiment and certain present preferred method of practicing the invention proceed.

BRIEF DESCRIPTION OF THE DRAWINGS

In the accompanying drawings I show a certain present preferred embodiment of my invention in which.

DESCRIPTION OF A PREFERRED EMBODIMENT

Figure 1:
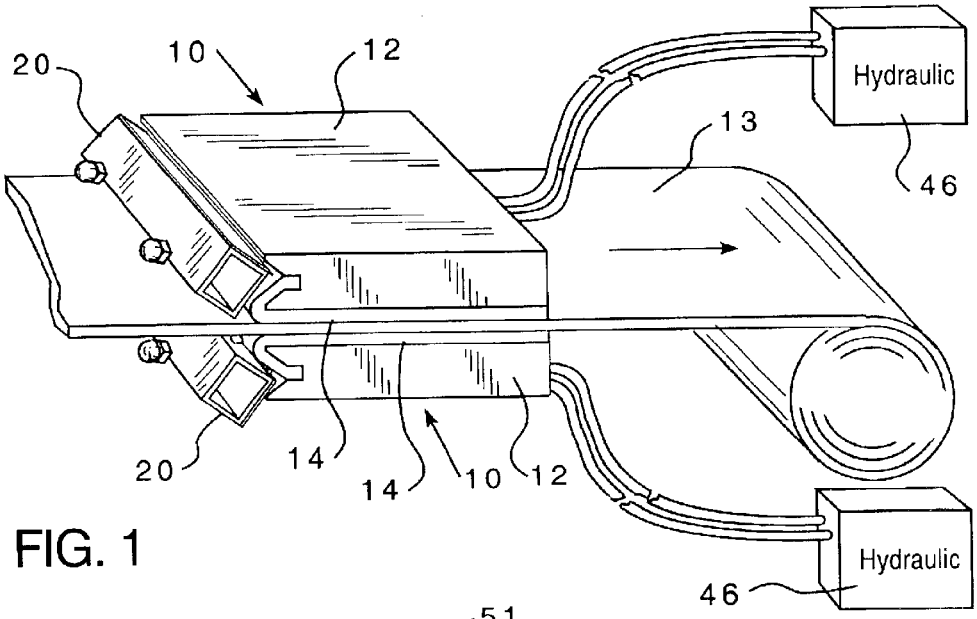
FIG. 1 is a perspective view of a portion of a continuous process using the drag board assemblies of the present invention.
Figure 2:
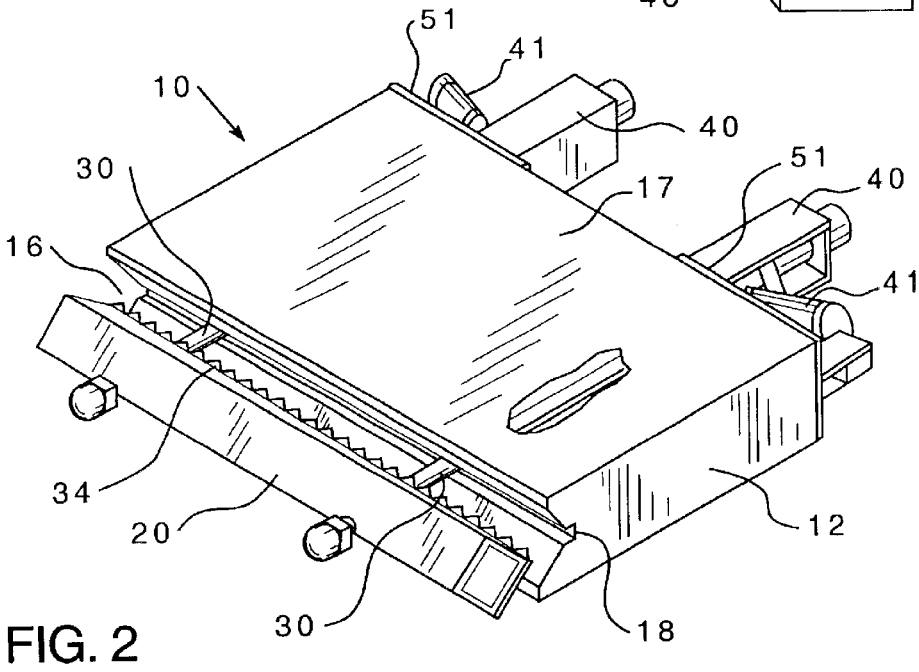
FIG. 2 is a perspective view of the drag board looking to the leading edge section thereof without a contact pad in place to show details of construction of the same leading edge section and locking bar arrangement and with a portion cut away to show one draw bar within the substrate.

Referring now to the drawings there is shown a drag board assembly 10 embodying my present inventions, including an elongated substrate 12 formed in this embodiment of an ultrahigh molecular weight polyurethane which, as is well known in the art, is resistant to oil, acid and other chemicals. FIG. 1 shown a pair of drag board assemblies 10 in a somewhat diagrammatic representation arranged for wiping opposing surfaces of a continuous strip of material 13. Other applications include providing tension to portions of the strip on a processing line to facilitate handling. The drag board assembly 10 includes a contact pad 14 which is secured to the substrate 12 as will be described in specific detail hereinafter. FIG. 2 shows the drag board assembly 10 without an attached contact pad 14 for showing details of construction, the view looking to the leading edge section 16 of the substrate 12 which is the initial portion contacted by a moving strip on a processing line. The upper surface 17 of the substrate receives the contact pad 14, the same upper surface also being known as the working surface of the drag board assembly 10. The leading edge section 16 of the substrate 12 has a generally triangular cross-sectional shape, as shown, formed with a centrally disposed, axially extending groove 18 extending between the opposing sides of the substrate 12. A locking bar 20 having a generally square shaped cross-section is arranged ahead of the leading edge section 16 of the substrate 12 and is shaped such that its inner section, as shown, compliments the triangular shape of the leading end section 16 and would be snugly received therein.

Figure 4:
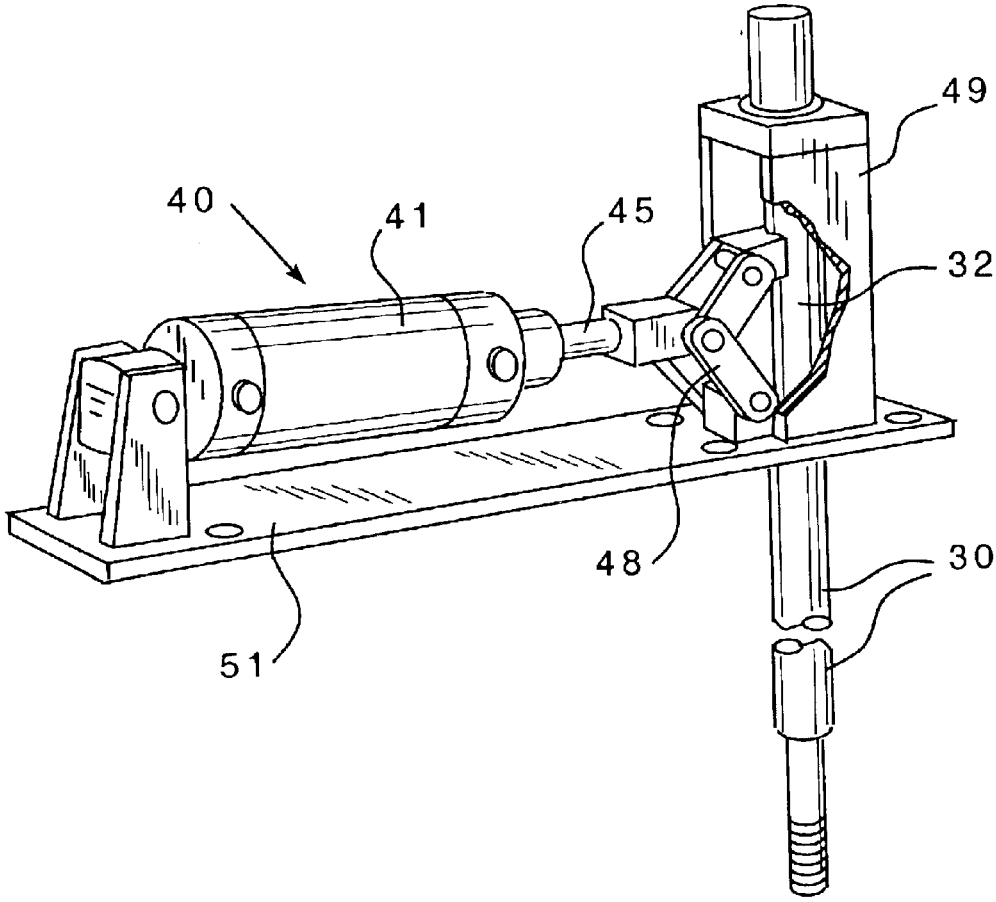
FIG. 4 is a perspective view of power cylinder-draw bar assembly forming part of the power source for applying and releasing a compressive force on the locking arrangement with a part cut away to show details of construction.
Figure 5:
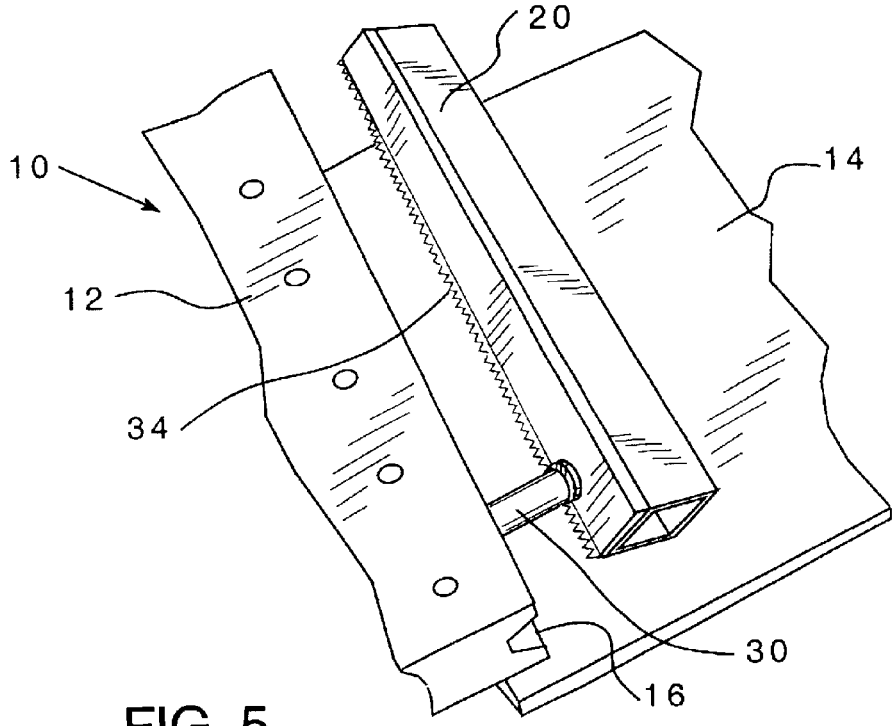
FIG. 5 is a perspective view of part of the locking bar arrangement showing details of construction.

The locking bar 20 is arranged to be selectively displaced from and returned to the confines of the leading end section 16 and the substrate 12. A pair of parallel, spaced elongated draw bars 30 are suitably secured at their inner ends to the locking bar 20, as shown, the draw bars slidably arranged in the substrate 12 in passageways formed therein and pass through the groove 18. The outer end section 32 of each 10 draw bar 30 has a larger diameter than the rest of the draw bar with the same outer end section 32 being arranged to a power cylinder assembly 40 as shown in FIG. 4 which power cylinder forms part of the power source for applying and releasing a compressive force on the contact pad 14 as will be more fully described hereinafter.

An elongated rod member 34 having saw blade-like serrations or protuberances formed on its surface is secured to the inner corner section of the locking bar 20. The rod member 34 is shaped and sized to fit within the confines of the groove 18 of the leading edge section 16 of the substrate 12. When the locking bar 20 is drawn into the leading edge section 16 the rod member 34 will be received into part of the groove 18, the significance of which arrangement will be more fully appreciated as this description proceeds.

Figure 3:
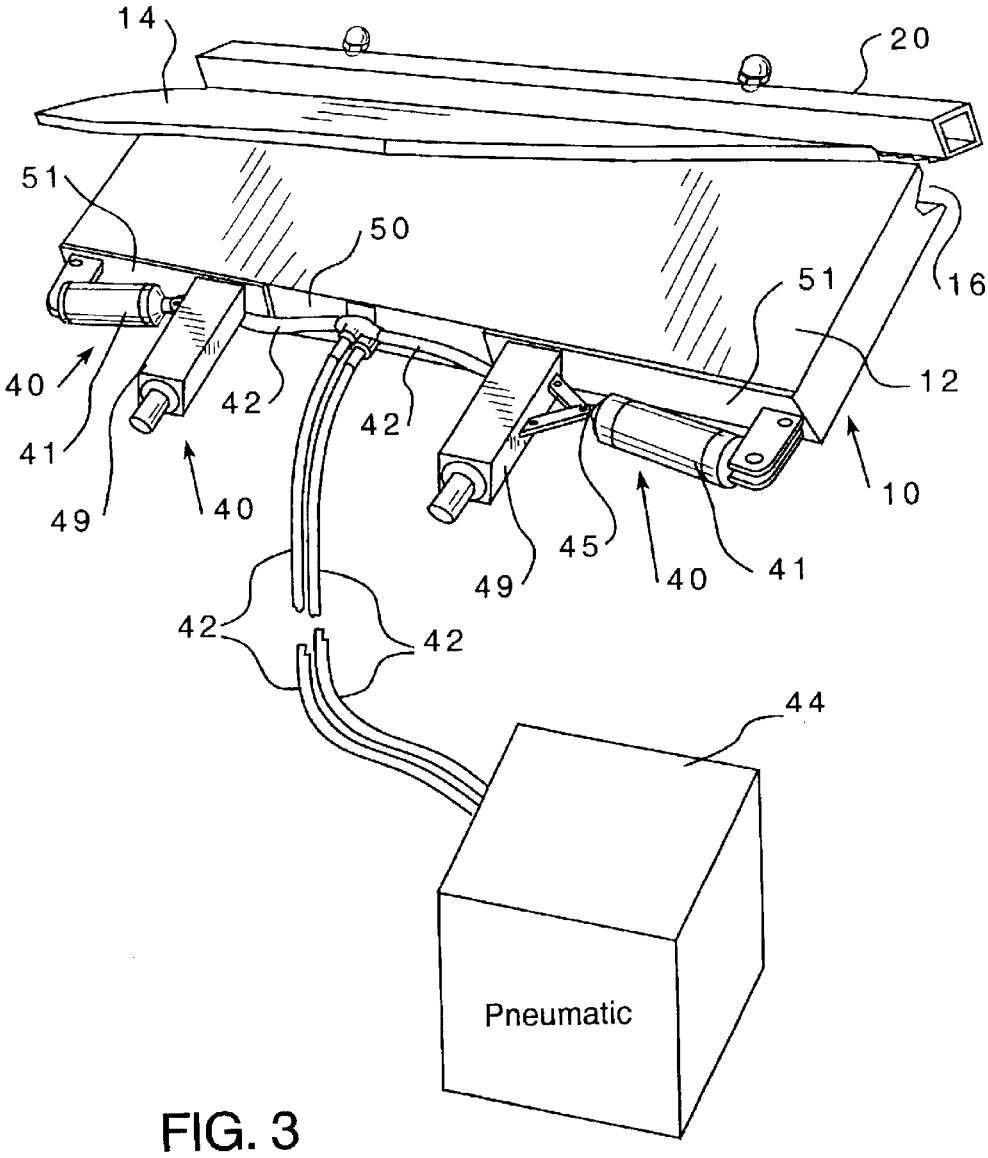
FIG. 3 is a perspective view of the same drag board of FIG. 2 looking to the trailing edge section thereof with a contact pad secured in place as it would be before being engaged by strip material moving in a continuous process showing details of construction of the power source which applies and releases a compressive force on the locking bar arrangement.

FIG. 3 shows the drag board 10 looking from the trailing edge section 50 of substrate 12, upon which is arranged elements of a power source for selectively moving the locking bar 20 into and out of the leading edge section 16 for applying and releasing a compressive force on one end section of the contact pad 14. The power source includes a pair of oppositely arranged identical power cylinder assemblies 40, one of which is clearly shown in FIG. 4. The power cylinder assembly 40 includes a power cylinder 41 and is operatively connected by suitable tubing 42 shown in FIG. 3 coupled with a pneumatic pressure source 44 and in FIG. 1 coupled with a hydraulic pressure source 46 both well known and shown digramatically, either being suitable for applying activating forces to the piston, not shown, within the housing of the power cylinder 41. The free end 45 of the piston of the power cylinder 41 is operatively secured, as shown, to pivotable roller chain linkages 48 which, in turn, are coupled to the outer end section 32 of the draw bar 30. The draw bar 30 is arranged to slide within the confines of a housing 49. Selective activation of the pneumatic pressure source 44 or hydraulic pressure source 46 will cause the piston rod 45 of each of the power cylinder assemblies 40 to either extend or retract to move draw bars 30 and the locking bar 20 into or out of the leading edge section 16 of the substrate 12 applying or releasing a compressive force on the one end section of the contact pad 14. The serrated rod member 34 will serve to positively secure the contact pad 14 to the substrate 12. The power cylinder 41 and draw bar housing 49 are suitably secured to a mounting plate 51, as shown, which, in turn, is suitably secured to the trailing edge section 50 of the substrate 12. It is to be clearly understood that here are oppositely arranged power cylinder assemblies 40 with the description herein of the one assembly pertaining to both illustrated power cylinder assemblies.

FIG. 3 shows the contact pad 14 as it would appear when it is initially secured to the substrate 12. When the drag board assembly 10 is emplaced in the processing line for wiping or tensioning the moving strip, the contact pad 14 will obviously be flattened onto the work surface of the substrate 12.

Figure 6:
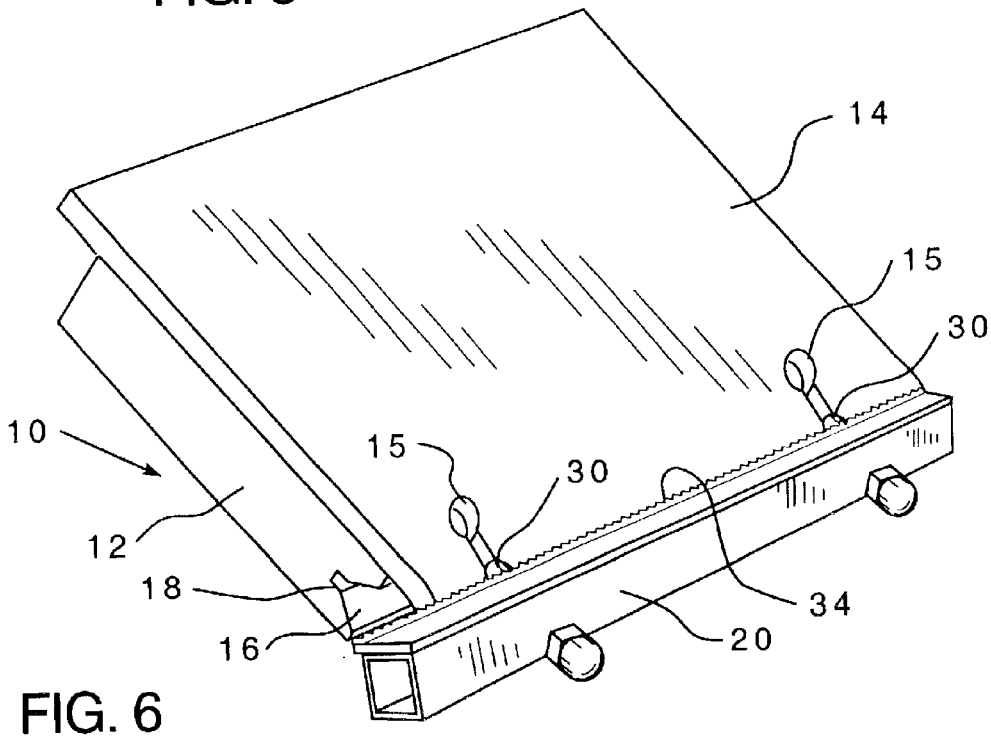
FIG. 6 is a perspective view of a contact pad showing details of construction of the end portion which would be engaged by the locking bar arrangement for securing the contact pad to the substrate.

As should be clearly understood, initial installation of a contact pad 14 with a substrate 12 is simply, rapidly, efficiently, and cost-effectively done by simply activating the power cylinder assemblies 40, to retract the locking bar 20 from the leading edge section 16 of the substrate, emplacing the contact pad 14 which is provided with key hole like slots 15 as shown in FIG. 6 onto the draw bars 20, then activating the power cylinder assemblies 40 to urge the locking bar 20 and serrated rod member 34 into the confines of the leading edge section 16 and groove 18, respectively, to urge a positive locking, compressive force into the contact pad 14.

Whenever it is necessary to remove a contact pad 14 for replacement this procedure is reversed, the contact pad removed and a new one installed onto the substrate 12.

It would be clearly apparent to one skilled in the art of drag board assemblies that modifications could be made to the structure of this invention. For example, the contact pad 14 may be felt, carpeting, or an abrasive material, while the substrate 10 may be formed of wood, plastic, or plastic derivative, polyurethane, metal, or any combination of these materials. The power source for providing a compressive locking force to the contact pad 14 may be mechanical such as an electrical powered motorized system or manually powered. The drag board assembly 10 of this invention as described may not only be modified structurally but is useable in various processes such as slitting, pickling, galvanizing, leveling, and others. It should also be clearly recognized how the advantages of the drag board assembly of this invention, as indicated in the introductory section of the specification are realized. Various other modifications and advantages of the drag board assembly and the method of applying a contact pad to a drag board of this invention would be understood by those skilled in this art.

While I have shown and described a present preferred embodiment of this invention and method of practicing the invention, it is to be distinctly understood that the invention is not limited thereto, but may be otherwise embodied and practiced within the scope of the following claims.

I claim:

1. A drag board assembly comprising:

an elongated substrate having an upper working surface, lower surface, leading edge section, and trailing edge section;

said leading edge section constructed and arranged for receiving one edge section of a contact pad;

locking means for engaging the one edge section of the contact pad for selectively securing and releasing the contact pad in said leading edge section; and said locking means includes a power source for applying and releasing a compressive force on the one edge section of the contact pad.

2. A drag board as set forth in claim 1 wherein said locking means includes a pneumatic power source for applying and releasing a compressive force on the one edge of a contact pad.

3. A drag board assembly as set forth in claim 1 wherein said locking means includes a hydraulic power source for applying and releasing a compressive force on the one edge section of a contact pad.

4. A drag board assembly as set forth in claim 1 wherein said locking means includes a locking bar received in said edge section constructed and arranged to selectively engage for securing and disengage the one edge section of a contact pad.

5. A drag board assembly as set forth in claim 1 wherein said leading edge section defines an axially extending groove; and wherein said locking means is arranged to secure the one edge section of a contact pad within said groove.

6. A drag board assembly as set forth in claim 5 wherein said locking means includes an axially extending rod member having protuberances for gripping the one edge section of a contact pad when it is placed in said groove; and wherein said groove is shaped for receiving said rod member.

7. A drag board assembly as set forth in claim 1 wherein said contact pad has one edge section thereof secured in said leading edge section by and releasable from said locking means.

8. A drag board assembly as set forth in claim 1 wherein said substrate and said locking means are constructed and arranged such that obstruction to said upper working is avoided.

9. A method of applying a contact pad to an elongated drag board, comprising: providing said elongated drag board with an upper working surface and having a leading edge section constructed and arranged for receiving one edge section of a contact pad, inserting the one edge section of said contact pad onto the leading edge section and over a lower surface of said elongated drag board; and securing the one edge section of said contact pad in the leading edge section of said elongated drag board; and said securing uses a power source for applying a securing force to the contact pad.

10. A method of applying a contact pad to a drag board as set forth in claim 9 wherein said power source is either hydraulic or pneumatic.

11. A method of applying a contact pad to a drag board as set forth in claim 9 wherein said step of securing of the one edge section of said contact pad avoids any obstructing of said lower surface of the drag board.

12. A method of applying a contact pad to a drag board as set forth in claim 9 wherein said step of securing the one edge section of said contact pad includes using an axially extending rod member with protuberances to grip and penetrate the one edge section of the contact pad, and includes impelling a compressive force to said rod member to urge the one edge section of the contact pad into engagement with the leading edge section of the drag board.

* * * * *